US011642669B2

(12) United States Patent
Wronko

(10) Patent No.: US 11,642,669 B2
(45) Date of Patent: May 9, 2023

(54) SINGLE-LAYER MICROFLUIDIC DEVICE AND METHODS OF MANUFACTURE AND USE THEREOF

(71) Applicant: Group K Diagnostics, Inc., Philadelphia, PA (US)

(72) Inventor: Brianna Wronko, Philadelphia, PA (US)

(73) Assignee: Group K Diagnostics, Inc., Philadelphia, PA (US)

( * ) Notice: Subject to any disclaimer, the term of this patent is extended or adjusted under 35 U.S.C. 154(b) by 77 days.

(21) Appl. No.: 16/161,896

(22) Filed: Oct. 16, 2018

(65) Prior Publication Data

US 2019/0111425 A1 Apr. 18, 2019

Related U.S. Application Data

(60) Provisional application No. 62/573,997, filed on Oct. 18, 2017.

(51) Int. Cl.
*B01L 3/00* (2006.01)

(52) U.S. Cl.
CPC ... *B01L 3/502707* (2013.01); *B01L 3/502715* (2013.01); *B01L 2200/12* (2013.01);
(Continued)

(58) Field of Classification Search
CPC ..... B01L 3/502707; B01L 3/502715
See application file for complete search history.

(56) References Cited

U.S. PATENT DOCUMENTS 2,129,754 A 9/1938 Yagoda
5,639,423 A 6/1997 Northrup et al.
(Continued)

FOREIGN PATENT DOCUMENTS

CA 2849980 A1 4/2013
EP 2589435 A1 5/2013
(Continued)

OTHER PUBLICATIONS

Rapid prototyping of paper based microfluidics with wax for low cost portable bioassay Yao Lu, Weiwei Shi, Lei Jiang, Jianhua Qin, Bingcheng Lin Electrophoresis 2009, 30, 1497-1500 (Year: 2009).*
(Continued)

*Primary Examiner* — Brian R Gordon
*Assistant Examiner* — Dwan A Gerido
(74) *Attorney, Agent, or Firm* — Fox Rothschild LLP

(57) ABSTRACT

The disclosure relates to methods of manufacturing and using a single layer microfluidic for detecting target analytes, including obtaining a single layer sheet of paper; depositing wax boundaries onto the paper in a plurality of patterns including a main channel, fluid transfer channels, and an independent diagnostic area corresponding to each fluid transfer channel; melting the wax through the paper; depositing diagnostic components onto the diagnostic areas; depositing a continuous wax backing; and cutting devices from the paper. The disclosure also relates to a method of capturing an image of the micro fluidic device to generate diagnostic results corresponding to the diagnostic components by: identifying at least two panels from the image; and determining a color for each panel of the at least two panels; and generating for display, using the computing device, a graphical user-interface including at least one component visualizing the diagnostic results.

7 Claims, 5 Drawing Sheets

(52) U.S. Cl.
CPC ... *B01L 2300/021* (2013.01); *B01L 2300/027* (2013.01); *B01L 2300/0681* (2013.01); *B01L 2300/0825* (2013.01); *B01L 2300/0877* (2013.01); *B01L 2300/126* (2013.01); *B01L 2300/161* (2013.01); *B01L 2400/088* (2013.01)

(56) References Cited

U.S. PATENT DOCUMENTS 5,705,813 A 1/1998 Apffel et al.
5,726,404 A 3/1998 Brody
6,146,589 A 11/2000 Chandler
6,249,593 B1 6/2001 Chu et al.
D456,910 S 5/2002 Clark et al.
6,500,323 B1 12/2002 Chow et al.
6,576,194 B1 6/2003 Holl et al.
6,645,432 B1 11/2003 Anderson et al.
6,673,593 B2 1/2004 Mastromatteo et al.
6,686,184 B1 2/2004 Anderson et al.
6,712,925 B1 3/2004 Holl et al.
6,719,868 B1 4/2004 Schueller et al.
7,125,711 B2 10/2006 Pugia et al.
7,226,562 B2 6/2007 Holl et al.
7,267,938 B2 9/2007 Anderson et al.
7,282,240 B1 10/2007 Jackman et al.
7,323,143 B2 1/2008 Anderson et al.
7,374,721 B2 5/2008 Huang et al.
7,452,509 B2 11/2008 Cox et al.
7,459,127 B2 12/2008 Pugia et al.
7,550,267 B2 6/2009 Hawkins et al.
D598,126 S 8/2009 Alvarez-Icaza et al.
7,604,965 B2 10/2009 McBride et al.
7,655,470 B2 2/2010 Ismagilov et al.
7,682,817 B2 3/2010 Cohen et al.
7,695,629 B2 4/2010 Salamitou et al.
7,708,949 B2 5/2010 Stone et al.
7,736,890 B2 6/2010 Sia et al.
D621,060 S 8/2010 Handique
D650,090 S 12/2011 Odeh
D650,091 S 12/2011 Odeh
8,206,664 B2 6/2012 Lin
8,206,992 B2 6/2012 Reches et al.
D669,191 S 10/2012 Handique
8,337,778 B2 12/2012 Stone et al.
8,377,710 B2 2/2013 Whitesides et al.
8,501,416 B2 8/2013 Linder et al.
8,603,832 B2 12/2013 Whitesides et al.
8,628,729 B2 1/2014 Carrilho et al.
8,758,704 B2 6/2014 Baril
8,784,749 B2 7/2014 Yang et al.
8,821,810 B2 9/2014 Whitesides et al.
D714,955 S 10/2014 Markovsky et al.
8,911,989 B2 12/2014 Lee et al.
8,986,628 B2 3/2015 Stone et al.
9,011,798 B2 4/2015 Shen et al.
9,023,641 B2 5/2015 Rodriguez et al.
D734,482 S 7/2015 Peterman et al.
9,103,787 B2 8/2015 Renna et al.
9,116,146 B2 8/2015 Shen et al.
9,138,743 B2 9/2015 Yager et al.
9,150,913 B2 10/2015 McBride et al.
9,193,988 B2 11/2015 Whitesides et al.
9,346,048 B2 5/2016 Zhou et al.
9,452,431 B2 9/2016 Zhou et al.
D770,638 S 11/2016 Whitehead et al.
9,488,613 B2 11/2016 Bosch et al.
9,528,987 B2 12/2016 Yager et al.
9,556,478 B2 1/2017 Zhou et al.
9,586,204 B2 3/2017 Hong et al.
9,606,116 B2 3/2017 Edwards et al.
9,616,425 B2 4/2017 Zhou et al.
9,636,677 B2 5/2017 Zhou et al.
9,664,679 B2 5/2017 Whitesides et al.
D794,210 S 8/2017 Jarvius et al.
9,791,434 B2 10/2017 McCord et al.
9,810,658 B2 11/2017 Crooks et al.
9,891,207 B2 2/2018 McCord et al.
D841,186 S 2/2019 Chao
2003/0104510 A1 6/2003 Yu
2007/0099290 A1 5/2007 Iida et al.
2009/0298191 A1* 12/2009 Whitesides ..... G01N 33/523 436/164
2010/0216126 A1 8/2010 Balachandran et al.
2012/0198684 A1* 8/2012 Carrilho ..... B01L 3/502707 29/527.1
2013/0034908 A1* 2/2013 Barstis ..... G01N 21/78 436/124
2014/0017693 A1* 1/2014 Mao ..... A61B 10/0045 435/6.12
2014/0134603 A1 5/2014 Sia et al.
2014/0170679 A1 6/2014 Aitchison et al.
2014/0295415 A1* 10/2014 Rolland ..... B01L 7/52 435/6.1
2015/0238955 A1 8/2015 Lee et al.
2015/0284668 A1 10/2015 Hsu et al.
2015/0330887 A1 11/2015 Shin et al.
2015/0367341 A1* 12/2015 Zhou ..... B01L 3/502746 422/430
2016/0016166 A1 1/2016 Rolland et al.
2016/0051980 A1* 2/2016 Hong ..... B01L 3/5023 506/39
2016/0144358 A1 5/2016 Patel
2016/0243546 A1 8/2016 Thuo et al.
2016/0291039 A1 10/2016 Garnier et al.
2016/0310942 A1 10/2016 Yager et al.
2017/0023470 A1 1/2017 Bronneberg et al.
2017/0043341 A1* 2/2017 Benco ..... B01L 3/502707
2017/0067832 A1 3/2017 Ferrara, Jr. et al.
2017/0067881 A1 3/2017 McCord et al.
2017/0136457 A1 5/2017 Bercovici et al.
2017/0173578 A1 6/2017 Crooks et al.
2017/0181278 A1 6/2017 Lessing et al.
2017/0198329 A1 7/2017 Ayyub et al.
2017/0218425 A1 8/2017 Chen et al.
2017/0234795 A1 8/2017 Issadore et al.
2018/0036727 A1 2/2018 Li et al.
2018/0369808 A1 12/2018 Wronko
2019/0111425 A1 4/2019 Wronko

FOREIGN PATENT DOCUMENTS

EP 2761279 A2 8/2014
EP 2773775 A1 9/2014
EP 2972244 A1 1/2016
WO 2010102294 A1 9/2010
WO 2016/140990 A1 9/2016
WO 2016/145050 A1 9/2016
WO 2016/161430 A1 10/2016
WO 2017/083926 A1 5/2017
WO 2017/134313 A1 8/2017
WO 2017/184665 A1 10/2017

OTHER PUBLICATIONS 1000-fold sample focusing on paper-based microfluidic devices. Tally Rosenfeld and Moran Bercovici Lab Chip, 2014, 14, 4465-4474 (Year: 2014).*
Creating compact and microscale features in paper-based devices by laser cutting. Md. Almostasim Mahmud, Eric J.M. Blondeel, Moufeed Kaddoura, Brendan D. MacDonald Analyst, 2016, 141,6449 (Year: 2016).*
Multiplex Lateral-Flow Test Strips Fabricated by Two-Dimensional Shaping. Erin M Fenton, Monica R Mascarenas, Gabriel P Lopez, Scott S Sibbett Applied Materials and Interfaces vol. 1 No 1, 124-129, 2009 (Year: 2009).*
Muller et al., "Automatic Paper Chromatography," Analytical Chemistry, 21(9):1123-1125 (1949).
Zhong et al., "Investigation of wax and paper materials for the fabrication of paper-based microfluidic device", Microsystem Technologies, 18:649-659 (2012).
Fan et al., "Fully enclosed paper-based microfluidic devices using bio-compatible adhesive seals", Microsystem Technologies, 24:1783-1787 (2017).

(56) References Cited

OTHER PUBLICATIONS

Lopez-Ruiz et al., "Smartphone-based simultaneous pH and nitrite colorimetric determination for paper microfluidic devices", Analytical chemistry, 86:9554-9562 (2014) Abstract.
International Search Report dated Apr. 22, 2019 for PCT/US2018/056086.
Written Opinion of the International Searching Authority dated Apr. 22, 2019 for PCT/US2018/056086.
Martinez et al. "FLASH: A rapid method for prototyping paper-based microfluidic devices", Lab Chip, 2008; 8(12): 2146-2150.
Martinez et al. "Patterned Paper as a Platform for Inexpensive, Low Volume, Portable Bioassays", Angew Chem Int Ed Engl. 2007; 46(8): 1318-1320.
Carriho et al. "understanding Wax Printing: A Simple Micropatteming Process for Paper-Based Microfluidics", Anal. Chem. 2009, 81, 7091-7095.
Carrilho et al. "Paper Microzone Plates", Anal. Chem. 81:5990-5998, 2009 (Year: 2009).
Rosenfeld et al., "1000-fold sample focusing on paper-based microfluidic devices," Lab on a Chip, 14(23):4437-4576 (2014).
European Search Report dated Jun. 17, 2021 for EP 18868778.4, 14 pp.

* cited by examiner

SINGLE-LAYER MICROFLUIDIC DEVICE AND METHODS OF MANUFACTURE AND USE THEREOF

This application claims the benefit of priority to U.S. Provisional Patent Application No. 62/573,997 filed Oct. 18, 2017, which is hereby incorporated by reference in its entirety.

BACKGROUND

Point-of-care (POC) diagnostics are inherently attractive in many resource-limited settings where the healthcare, transportation, and distribution infrastructure is underdeveloped and underfunded. A main advantage of a POC diagnostic is the ability to diagnose disease without the support of a laboratory infrastructure. This increases access, removes the need for sample transport, and shortens turnaround times from weeks (or months) to hours or minutes. As a result, more patients are effectively diagnosed, enabling faster and more complete treatment. Although paper-based sensors have been known and used for several years, paper POC devices that are both accurate and economically feasible have been difficult to achieve due to a number of factors, such as poor limits of detection, high non-specific adsorption, unstable reagents, long analysis time, complex user-technology interface, detection method, and poor sensitivity. Thus, there is a need for paper POC devices that can be readily manufactured at a large scale, and that are inexpensive, user friendly, robust, sensitive, stable, and portable.

SUMMARY

The present disclosure generally relates to methods of manufacturing and using a rapid, single-layer microfluidic device that can perform a variety of diagnostic assays on a biological sample (e.g., blood, urine, sputum, saliva, or other bodily fluid). The disclosure also relates to methods of capturing an image of a microfluidic device to generate diagnostic results corresponding to diagnostic components.

In one aspect, the disclosed technology relates to a method of manufacturing a single layer microfluidic, including: obtaining a single layer sheet of hydrophilic, porous paper; depositing wax boundaries onto the paper in a plurality of patterns, wherein each pattern corresponds to a single device including a main channel, at least two fluid transfer channels, and an independent diagnostic area corresponding to each fluid transfer channel, wherein the main channel is in fluid communication with each of the fluid transfer channels, which are independent of each other and in fluid communication with their corresponding diagnostic areas; heating the paper of step (b) at a temperature of about 120° C. to about 150° C. to melt the wax through the thickness of the paper, and then cooling the paper to room temperature; depositing one or more diagnostic components onto one or more of the diagnostic areas; depositing a continuous wax backing onto the back of the paper; and cutting out one or more single layer microfluidic devices from the paper. In one embodiment, the method further includes depositing at least one identifying indicator onto the paper outside of the main channel, fluid transfer channels, and diagnostic areas before step (f). In another embodiment, at least one identifying indicator is a QR code or bar code. In another embodiment, at least one identifying indicator is a calibration region. In another embodiment, the hydrophilic, porous paper is filter paper. In another embodiment, at least one steps of (b), (d), and (e) is performed using a printer. In another embodiment, each of steps (b), (d), and (e) is performed using a printer. In another embodiment, step (d) is repeated after at least 10 minutes. In another embodiment, the wax backing fully covers the back of each device. In another embodiment, step (f) includes cutting out an array of two devices.

In another aspect, the disclosed technology relates to a single layer microfluidic device or array of single layer microfluidic devices manufactured by the foregoing method, wherein the device or array of devices includes: a single layer sheet of hydrophilic, porous paper; wax boundaries configured on the paper in a pattern including a main channel, at least two fluid transfer channels, and an independent diagnostic area corresponding to each fluid transfer channel, wherein the main channel is in fluid communication with each of the fluid transfer channels, which are independent of each other and in fluid communication with their corresponding diagnostic areas; one or more diagnostic components present in one or more of the diagnostic areas; and a continuous wax backing. In one embodiment, the single layer microfluidic device or array of devices further includes at least one identifying indicator present outside of the main channel, fluid transfer channels, and diagnostic areas. In another embodiment, the device includes one main channel, three fluid transfer channels, and three diagnostic areas. In another embodiment, the array includes two devices, each device including one main channel, three fluid transfer channels, and three diagnostic areas.

In another aspect, the disclosed technology relates to a method of detecting a plurality of target analytes, including: obtaining the foregoing single layer microfluidic device, wherein a first diagnostic area contains a first diagnostic component that includes a visual indicator and selectively associates with a first target analyte, and a second diagnostic area contains a second diagnostic component that includes a visual indicator and selectively associates with a second target analyte; depositing a biological sample onto the main channel or onto a paper filter coupled to the main channel; allowing the biological sample to flow into the first and second diagnostic areas, such that the biological sample chemically reacts with the diagnostic component in each diagnostic area; and observing visible changes in the first and second diagnostic areas, wherein the visible changes indicate the presence of the first and second target analytes, respectively. In one embodiment, the first and second target analytes are different from each other and are selected from aspartate transaminase, alkaline phosphatase, alanine aminotransferase, bilirubin, albumin, total serum protein, glucose, cholesterol, creatine, sodium, calcium, gamma glutamyl transferase, direct bilirubin, indirect bilirubin, unconjugated bilirubin, and lactate dehydrogenase. In another embodiment, the biological sample is a blood sample. In another embodiment, the first and second diagnostic components are different from each other and are selected from BCIP, α-ketoglutarate, glucose oxidase, horseradish peroxidase, cholesterol oxidase, hydroperoxide, diisopropylbenzene dihydroperoxide, an apolipoprotein B species, 8-quinolinol, or monoethanolamine, 2,4-dichloroaniline, 2,6-dichlorobenzene-diazonium-tetrafluoroborate, DIDNTB, a phenolphthalein anionic dye, NBT, methyl green, rhodamine B, 3,3',5,5'-tetramethylbenzidine, a diaphorase, methylthymol blue, a diazonium salt, and oxalacetic acid.

In another aspect, the disclosed technology relates to a method for capturing an image of a microfluidic device to generate diagnostic results including: obtaining, at a computing device, an image of a microfluidic device, wherein one or more diagnostic components have been deposited onto one or more diagnostic areas of the microfluidic device when the image is captured; processing, using the computing device, the image to generate diagnostic results corresponding to the diagnostic components by: identifying one or more panels from the image; and determining a color for the one or more panels; and generating for display, using the computing device, a graphical user-interface including at least one component visualizing the color and at least one component quantifying the color. In one embodiment, the captured image is received from a mobile device and the graphical user-interface is displayed at the mobile device.

BRIEF DESCRIPTION OF THE DRAWINGS

The accompanying drawings, which are incorporated herein and constitute part of this specification, illustrate non-limiting and non-exhaustive embodiments of the present disclosure, and, together with the description provided herein, serve to explain various features of the invention.

DETAILED DESCRIPTION

The present disclosure describes methods of manufacturing and using a rapid, single-layer microfluidic device.

Figure 1:
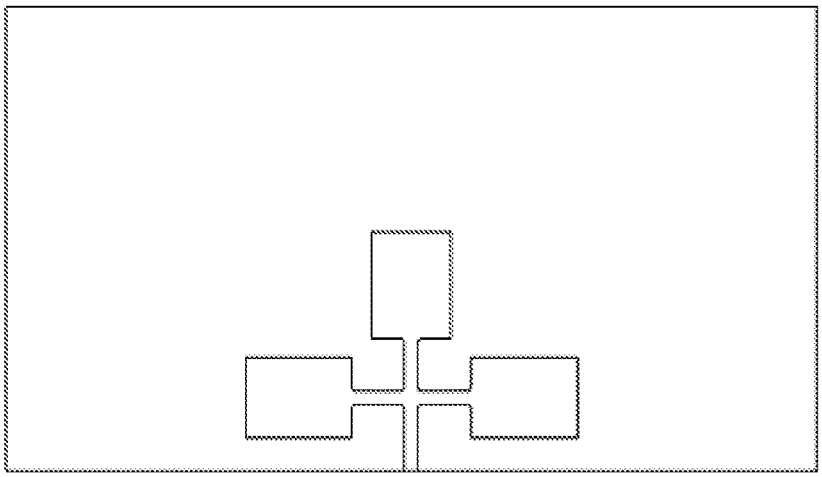
FIG. 1 shows an example of a microfluidic device in accordance with the present disclosure.

In general, the disclosed single-layer microfluidic device includes a single sheet of paper (a hydrophilic, porous substrate) on which a pattern of wax has been deposited. Non-limiting examples of suitable wax materials include polyethylene waxes, hydrocarbon amide waxes, ester waxes, and combinations thereof. The wax defines boundaries of a main channel, at least two fluid transfer channels, and independent diagnostic areas corresponding to each fluid transfer channel. The main channel is in fluid communication with each of the fluid transfer channels, which are independent of each other and in fluid communication with their corresponding diagnostic areas. An example of a single-layer microfluidic device of the present disclosure is shown in FIG. 1. Although the shapes of the diagnostic areas are depicted as generally rectangular, other shapes (e.g., T-shaped diagnostic areas or rounded diagnostic areas) may also be used. In some embodiments, the shape of the diagnostic area is at least partially ornamental in nature. Additional examples of a single-layer microfluidic device of the present disclosure are shown in FIGS. 2A, 2B, 3A, and 3B.

The microfluidic device may also include a barrier applied to the back of the single sheet of paper (e.g., a wax backing). Such a backing covers all or substantially all of the back side of the microfluidic device. There are several advantages of the backing. For instance, the backing stabilizes and strengthens the device, making it more durable for use. The backing also protects the user from contamination and/or pathogens by preventing biological samples from leaking through the paper. In general, the backing is formed from a material that is harder than the paper.

Figure 4:
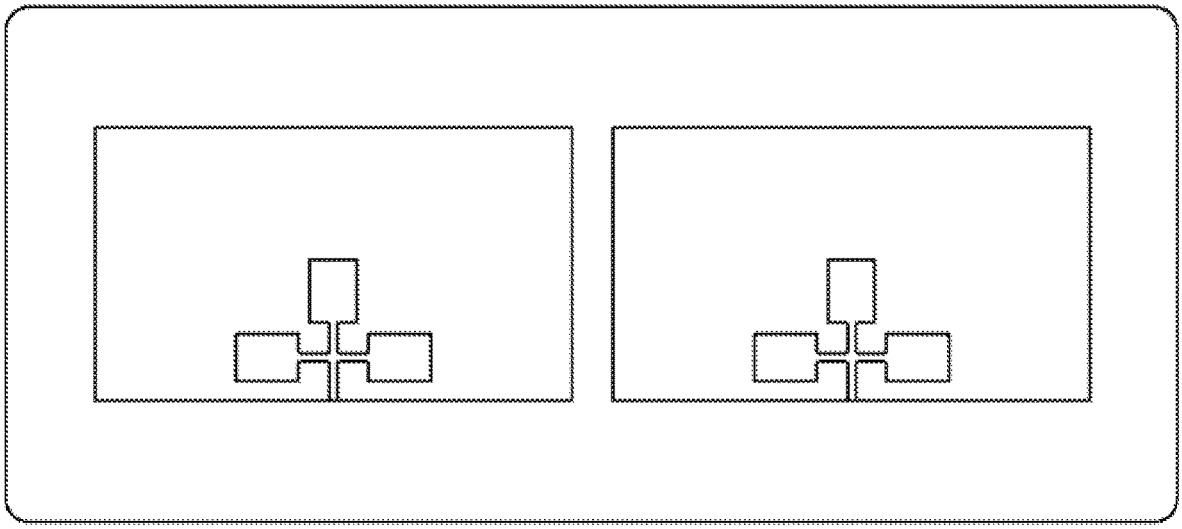
FIG. 4 shows an example of a microfluidic device having a two-assay array in accordance with the present disclosure.

Non-limiting examples of the backing material include wax, acrylic, polyurethane, plastic, thermoplastic, paper, metal, wood, cardboard, or fabric materials and combinations thereof. In some embodiments, the backing is about 50 μm to about 500 μm thick, such as about 50 μm to about 100 μm. The backing may be applied to a single device (as shown in FIG. 1) or may be applied across the backing of an array of devices (as shown in FIG. 4). When an array of devices is manufactured, each device in the array may have the same configuration (number of fluid transfer channels and diagnostic areas) but differ in terms of the diagnostic component(s) deposited in each diagnostic area. In some embodiments, an array of devices may contain 2, 3, 4, or more devices.

In one embodiment, the paper is filter paper or another hydrophilic, porous paper. In some embodiments, the paper is not nitrocellulose or the paper is not fabric.

As appropriate, various diagnostic components (e.g., reagents, dyes, probes, stabilizers, catalysts, and combinations thereof) are deposited onto the diagnostic areas of the device prior to use—i.e., before a biological sample is deposited on the device. Identifying indicia may also be printed onto the device prior to use. Non-limiting examples of suitable identifying indicia include QR codes, bar codes, color components (e.g., colored dots), patterns, shapes, and alphanumeric information. In some embodiments, the identifying indicia indicates the particular diagnostic assays that are present on the device. Other information that may be associated with identifying indicia includes patient information, lot number, expiration date, hospital information, information regarding the person using the device, tracking information and/or geolocation information.

Some of the identifying indicia, such as colored components, may be used for calibration purposes. Accordingly, in some embodiments, the device includes a calibration region containing colored components (e.g., circles of a single color) in order to facilitate calibrating a camera so that the camera will recognize and control for changes in lighting hue and/or intensity. The calibration region may also allow for camera focusing and/or prevent or mitigate blurriness.

The devices and arrays of devices may be stored at room temperature (about 20° C. to about 25° C.), or within a range of 10° C. to 27° C. In general, the devices and arrays are stored in packaging that is resistant to light and humidity.

Method of Manufacture

In general, the disclosed single-layer microfluidic device is manufactured by serially printing desired substances onto single sheets of paper. In some embodiments, the size of the paper is at least 8.5 inches×11 inches, such as normal printing paper, but other sizes (e.g., 8.5 inches×14 inches legal sized paper) may also be used. In some embodiments, one or more devices (e.g., 2, 3, 4, 5, 6, 7, 8, 9, 10, 11, 12, or more devices), one or more arrays of devices (e.g., 2, 3, 4, 5, 6, or more arrays), and combinations thereof may be manufactured from a single sheet of paper. Suitable printers include but are not limited to inkjet printers, solid ink printers, and deposition printers. In some embodiments, the wax boundaries are printed first, and desired diagnostic components (e.g., reagents, dyes, probes, stabilizers, catalysts, and combinations thereof) are then printed onto desired diagnostic areas. Other examples of suitable diagnostic components include, but are not limited to, anticoagulants (e.g., EDTA or heparin), colorimetric probes, fluorescent probes, lysing agents, nanoparticles, and diluents. In general, each diagnostic area will contain 1, 2, 3, or 4 diagnostic components—e.g., a mixture containing a reagent that selectively associates with a target analyte and a dye; or a mixture containing a reagent that selectively associates with a target analyte, a dye, and a stabilizer; or other combinations.

Identifying indicia may be printed before or after the diagnostic components have been printed. The backing material may be printed onto the back of the paper before or after the diagnostic components have been printed.

In some embodiments, the backing is adhered to the paper using an adhesive material. Non-limiting examples of suitable adhesives include chemically inert substances such as glue, epoxy, resin, super glue, polyacrylamide, tape, non-absorbent polymer such as polydimethylsiloxane (PDMS), a polyether block amide (e.g., PEBAX®, commercially available from Arkema), a polyacrylate, a polymethacrylate (e.g., poly(methyl methacrylate)), a polyimide, polyurethane, polyamide (e.g., Nylon 6,6), polyvinylchloride, polyester, (e.g., HYTREL®, commercially available from DuPont), polyethylene (PE), polyether ether ketone (PEEK), fluoropolymers such as polytetrafluoroethylene (PTFE), perfluoroalkoxy, fluorinated ethylene propylene, and combinations thereof. In some embodiments, the adhesive is applied to the back of the paper before printing or manually applying the backing material.

Each printable fluid may be provided in a printer cartridge. To print wax boundaries and/or a wax backing, a printer cartridge containing melted wax may be used. Diagnostic components and combinations thereof may similarly be contained in printer cartridges, either individually or in combined solutions, so as to be easily selected as needed to manufacture a desired device.

Diagnostic components and/or backing material may be additionally or alternatively deposited onto the device manually, without the use of a printer.

Many types of commercially available wax-based solid inks are suitable for use in the disclosed methods as the ink provides a stronger visual indication of the printed channels. However, wax that does not contain ink is also suitable for use in the disclosed methods. Once the wax is patterned, the paper is heated (e.g., by placing the paper on a hot plate at a temperature of about 120-150° C.). Heating allows the wax material to substantially permeate the thickness of the paper substrate, so as to form a hydrophobic boundary that defines the dimensions of the channels and diagnostic areas.

Method of Use

The disclosed single-layer microfluidic device provides a platform for detecting and quantifying target analytes and biomarkers present in a biological sample, such as a bodily fluid.

Suitable biological samples include but are not limited to blood, urine, sputum, vaginal secretions, anal secretions, oral secretions, penile secretions, and saliva. The biological sample may be processed or unprocessed. Processing can include filtration, centrifugation, pre-treatment by reagents, etc. For example, a biological blood sample may be filtered to remove a component of the sample (e.g., whole blood may be filtered to remove red blood cells). The biological sample may also be mixed with a solution (e.g., distilled water or buffer) to form a fluid prior to depositing the sample onto the device.

Non-limiting examples of detectable analytes include antibodies, proteins (e.g., glycoprotein, lipoprotein, recombinant protein, etc.), polynucleotides (e.g., DNA, RNA, oligonucleotides, aptamers, DNAzymes, etc.), lipids, polysaccharides, hormones, prohormones, narcotics, small molecule pharmaceuticals, pathogens (e.g., bacteria, viruses, fungi, protozoa). In one embodiment, the target analyte includes one or more of aspartate transaminase (AST), alkaline phosphatase (ALP), alanine aminotransferase (ALT), bilirubin, albumin, total serum protein, glucose, cholesterol, creatine, sodium, calcium, gamma glutamyl transferase (GGT), direct bilirubin, indirect bilirubin, unconjugated bilirubin, and lactate dehydrogenase (LDH).

To use the device, a biological sample is deposited in the main channel, preferably at an inlet to the main channel. In some embodiments, a filter is provided upstream of the main channel. For example, a filter may be layered on top of a portion of the main channel (e.g., the inlet to the main channel). The biological sample may then be deposited onto the filter. The filtered portion of the sample then flows from the filter, into the main channel, and then into the fluid transfer channels, and then into the corresponding diagnostic areas. For example, a biological sample of whole blood may be deposited onto a filter to remove red blood cells, and allow filtered serum to flow into the main channel.

The biological sample may be deposited directly from a patient onto the device. For instance, a finger prick may be performed to produce a blood sample at the finger of a patient, which is then touched directly to the main channel, or to a filter upstream of the main channel, of the device. Alternatively, the biological sample may be deposited by an instrument, such as a pipette, capillary tube, eye dropper, or other similar instrument.

Once the sample has been deposited on the device and has flowed (e.g., by capillary action) to the diagnostic areas, diagnostic assays may occur in the diagnostic areas. Non-limiting examples of suitable diagnostic assays include one of more of the following reactions: redox reactions, isothermal amplification, molecular diagnostics, immunoassays (e.g., ELISA), and colorimetric assays. In some embodiments, a diagnostic area may remain inactive so that no reaction occurs with the sample. The diagnostic assays can determine the presence and quantity of a variety of target analytes or biomarkers, which are indicative of corresponding conditions such as, but not limited to, liver function, metabolic function, infectious diseases, cell counts, bacterial counts, viral counts, and cancers. By providing a plurality of diagnostic assays in a single device, one biological sample can be simultaneously subjected to a plurality of independent reactions that provide an informative landscape of data directed to one or more conditions of interest. In some embodiments, all of the diagnostic assays may be directed to a single condition of interest (e.g., liver disease, diabetes, etc.). In other embodiments, the diagnostic assays may be selected to provide a profile of patient information (e.g., glucose levels, electrolyte levels, kidney function, etc.).

During the diagnostic assay, certain diagnostic component (s) will selectively associate with a corresponding target analyte. As used herein, "selectively associates" refers to a binding reaction that is determinative for a target analyte in a heterogeneous population of other similar compounds. For example, the diagnostic component may be an antibody or antibody fragment that specifically binds to a target antigen. Non-limiting examples of suitable diagnostic components include 5-bromo-4-chloro-3-indolyl phosphate (BCIP), α-ketoglutarate, glucose oxidase, horseradish peroxidase, cholesterol oxidase, hydroperoxide, diisopropylbenzene dihydroperoxide, an apolipoprotein B species, 8-quinolinol, or monoethanolamine, 2,4-dichloroaniline, 2,6-dichlorobenzene-diazonium-tetrafluoroborate, bis (3',3"-diiodo-4',4"-dihydroxy-5',5"-dinitrophenyl)-3,4,5,6-tetrabromosulfonephtalein (DIDNTB), a phenolphthalein anionic dye, nitro blue tetrazolium (NBT), methyl green, rhodamine B, 3,3',5,5'-tetramethylbenzidine, a diaphorase, methylthymol blue, a diazonium salt, and oxalacetic acid.

In general, it takes about 1 minute or less for a biological sample to flow to each diagnostic area of a disclosed single-layer microfluidic device, and about 2 minutes or less for the sample to fill each diagnostic area. Example data related to biological samples of blood are provided in Table 1 below.

TABLE 1

| | Time to Reach Reaction Areas (Standard Deviation) | Time to Fill Reaction Areas (Standard Deviation) |
|---|---|---|
| Three-Channel Devices (n = 25 devices) | 6.5 s (2.8 s) | 57.0 s (21.3 s) |
| Six-Channel Devices (n = 15 devices) | 15.8 s (7.1 s) | 72.7 s (28.8 s) |

Overall, when using the disclosed single-layer microfluidic device, the diagnostic assay reactions complete in 20 minutes or less from the time a biological sample is deposited onto the device, and thus yield full diagnostic results in 20 minutes or less as well.

In some embodiments, the diagnostic component(s) include a visual indicator that exhibits a colorimetric and/or fluorometric response in the presence of the analyte of interest. For example, such visual indicators may become colored in the presence of the analyte, change color in the presence of the analyte, or emit fluorescence, phosphorescence, or luminescence in the presence of the analyte.

Computing System and Computing Architecture

Figure 5:
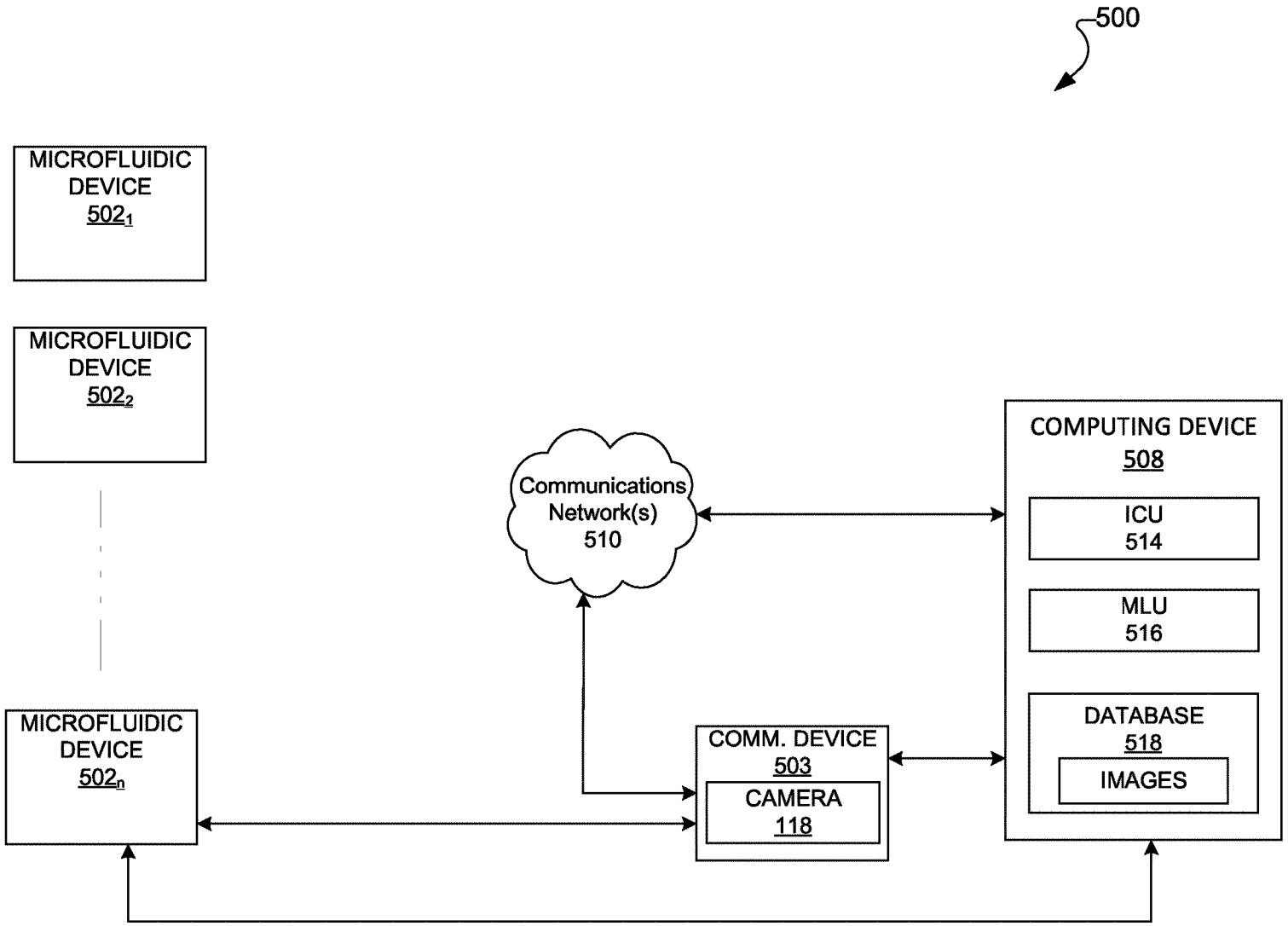
FIG. 5 shows an example computing environment including one or more microfluidic devices, a computing device, and a comm. device.

FIG. 5 illustrates an example computing environment 500 comprising one or more microfluidic devices $\mathbf{502}_1$, $\mathbf{502}_2$, $\mathbf{502}_N$, a computing device 508, and a comm. device 503, all of which may be deployed with the computing environment 500 to enable or otherwise automate a performing a variety of diagnostic assays on a biological sample. The comm. device 503 and the computing device 508 may be functionally and communicatively connected via a communications network 510, which may be an IP-based telecommunications network, the Internet, an intranet, a local area network, a wireless local network, a content distribution network, or any other type of communications network, as well as combinations of networks. Alternatively, the one or more microfluidic devices $\mathbf{502}_1$, $\mathbf{502}_2$, $\mathbf{502}_N$, the comm. device 503, and the computing device 508 may be functionally and communicatively connected according to a local arrangement, in which such devices directly interact with one another, such as via a hardline or wireline, or other physical and/or optical mechanism that enables operative communication, function, and data transfer.

Figure 2A:
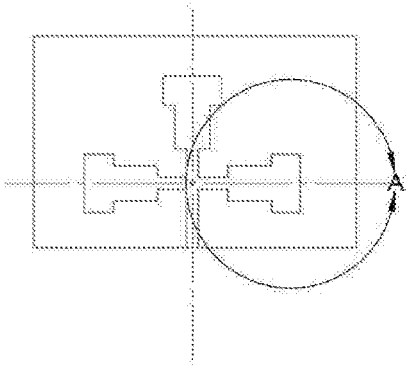
FIG. 2A shows another example of a microfluidic device in accordance with the present disclosure.
Figure 2B:
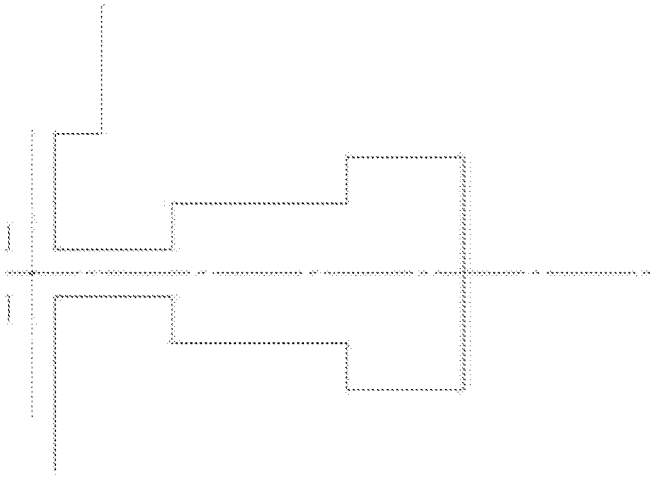
FIG. 2B shows an enlarged view of an example diagnostic area shown in circled area A of FIG. 2A.
Figure 3A:
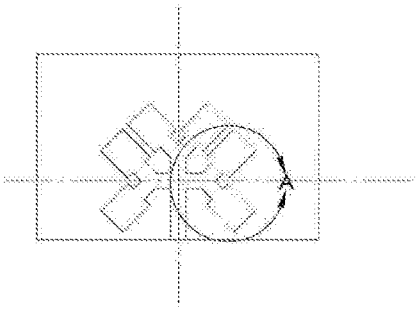
FIG. 3A shows another example of a microfluidic device in accordance with the present disclosure.
Figure 3B:
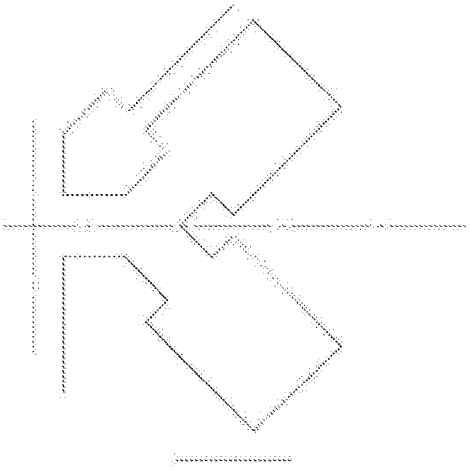
FIG. 3B shows an enlarged view of an example fluid transfer channel and two diagnostic areas shown in circled area A of FIG. 3A.

In the illustrated computing environment 500, each of the one or more microfluidic devices $\mathbf{502}_1$, $\mathbf{502}_2$, $\mathbf{502}_N$ may be a microfluidic device, as illustrated in FIGS. 1, 2A, 3A, and/or 4. The computing device 508 may be a processing device, processor, processors, mobile device, server computing device, and/or any other computing device capable of processing and/or interpreting computer instructions.

The computing device 508 includes an image-capturing unit 514 (illustrated as ICU 514) that captures or otherwise obtains images of the data output by and/or at the microfluidic device $\mathbf{502}_1$, $\mathbf{502}_2$, $\mathbf{502}_N$. In some embodiments, the ICU 514 may capture images of the entirety of one or more of the microfluidic device $\mathbf{502}_1$, $\mathbf{502}_2$, $\mathbf{502}_N$. The computing device 508 also includes a machine-learning unit 516 (illustrated as MLU 516) that executes various algorithms to process the data (e.g., images) captured at the microfluidic devices $\mathbf{502}_1$, $\mathbf{502}_2$, $\mathbf{502}_N$. In some embodiments, the computing device 508 may include a database 518 for storing and retrieving captured images. Although the database 518 of FIG. 5 is depicted as being located within the computing device 508, it is contemplated that the database 518 may be located external to the computing device 508, such as at a remote location, and may communicate with the computing device 508 via the communications network 510. Additionally, although the machine-learning unit 116 is illustrated as being located within the computing device 508, it is contemplated that the machine learning unit 516 may be located directly within the one or more single-layer microfluidic devices 502-506 as a form of executable instructions defining the algorithm(s) (e.g., as a software plug-in).

Referring generally again to FIG. 5, a user may interact with the comm. device 503 to initiate a process through which a variety of diagnostic assays may be performed on a biological sample. More specifically, and as will be described in further detail below with respect to FIG. 6, the comm. device 503 may be used to capture information corresponding to a particular patient, information corresponding to a biological sample of the patient, and automatically initiate various diagnostic assay processes. The comm. device 503 may be may be a personal computer, work station, mobile device, mobile phone, tablet device, processor, and/or other remote processing device capable of implementing and/or executing processes, software, applications, etc., that includes network-enabled devices and/or software, for communication over the communications network 530 (e.g., browsing the internet). Additionally, the comm. device 503 may include one or more processors that process software or other machine-readable instructions and may include a memory to store the software or other machine-readable instructions and data. The comm. device 503 may further include a microphone and/or camera (or other optical sensor) that can be used to capture images and/or image data, such as images of the microfluidic devices $\mathbf{502}_1$, $\mathbf{502}_2$, $\mathbf{502}_N$.

Figure 6:
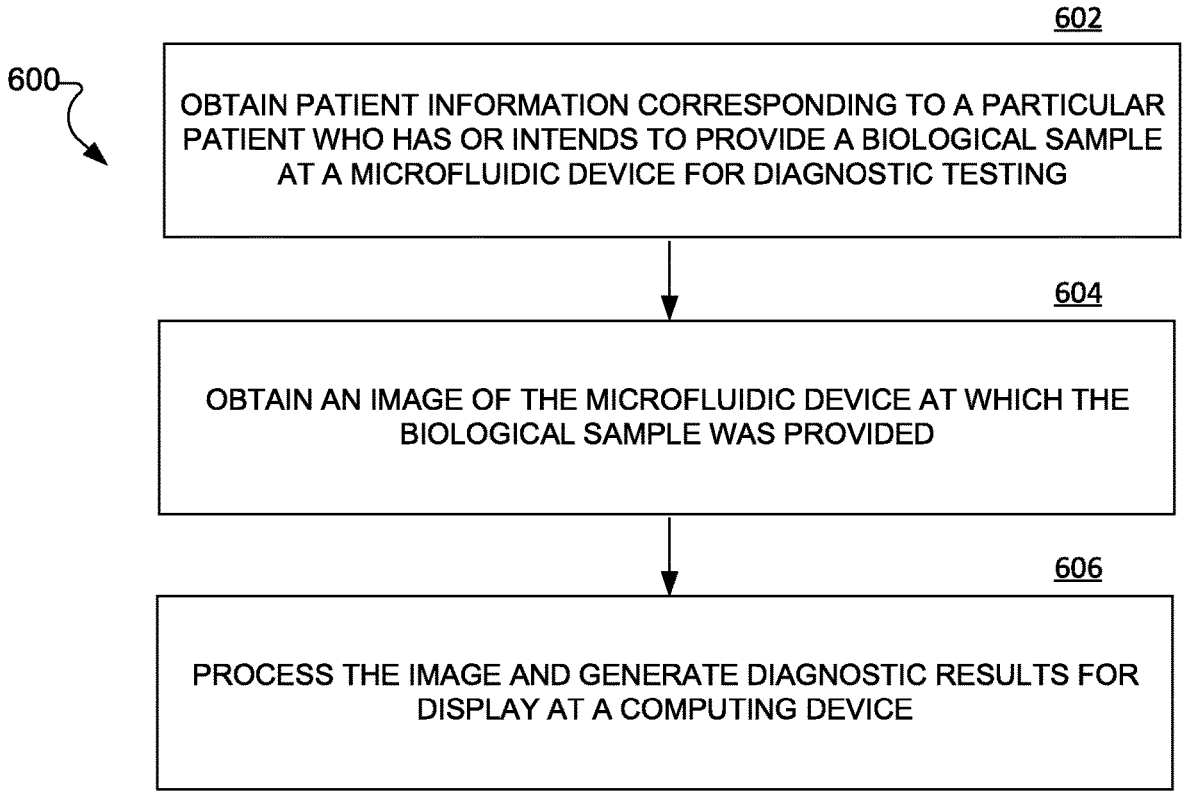
FIG. 6 shows an example process for capturing an image of a microfluidic device to generate diagnostic results.

FIG. 6 illustrates a flowchart of one example process 600 for processing diagnostic assay data and automatically generating diagnostic results. The process 600 describes operations performed in connection with the microfluidic device described herein and in particular FIGS. 1-4. In one specific example, the method 600 may represent an algorithm that can be used to implement one or more software applications that direct operations of a various components of the computing environment 500.

As illustrated, process 600 begins at 602, with obtaining patient information corresponding to a particular patient who has provided a biologic sample for diagnostic testing, or a patient who is interested in providing a biologic sample at a microfluidic device for diagnostic testing. In one specific example and with reference to FIG. 5, patient information may be obtained through a displayed code (e.g., a QR code or barcode) captured at the comm. device 503, which automatically transmits the patient information to the computing device 508.

At 604, an image corresponding to the microfluidic device containing the biologic sample of the particular patient is obtained. Stated differently, images of the biological sample obtained at one of the microfluidic devices 502-506 may be captured. In one specific example, an image of the diagnostic area illustrated in FIGS. 2B and 3B may be captured. In another example, a complete image of a microfluidic device may be captured. Referring to FIG. 5, the image may be captured at the comm. device 503 and transmitted to the computing device 508. Alternatively, the images may be captured directly at the computing device 508, for example, at the ICU 530.

At 606, the captured image is processed to display or otherwise provide diagnostic results of the processed biological sample. Initially, the captured image(s) may be analyzed to do detect panels. Referring to FIG. 5, the MLU 532 may employ a deep-learning model that automatically determines the location on a given image where certain objects are present, such as panels. The deep-learning model also classifies any identified objects, such as classifying the object as a panel.

Once the panels have been identified, a threshold and anchors of the image are determined. The anchors of the image are reference points that are known to the system (corners, the colored dots etc.) that enable the system to anchor its surroundings and properly segment objects from the captured images. The threshold is the pre-known highest and lowest colors on the card as well as the threshold of what is expected.

Based on the determined threshold and anchors, the bounding boxes of the image are generated that isolate the region of interest in the image. In an expected scenario, three rectangles should be identified during the bounding process, one rectangle corresponding to each panel of a given microfluidic device. If only two rectangles found, the system uses angles to calculate the third rectangle. If four rectangles are found, the system determines which of the identified rectangles is out of range. To do so, the system determines if any of the rectangles are overlapping. If so, the overlapping rectangles are sorted and separated. The remaining processed image is saved at the computing device 503 for future access and retrieval. In yet another embodiment, only one panel may be identified and solely used during color processing.

Once an image has been processed to identify the region of interest, the processed image(s) is used in color processing to determine diagnostic results. First, a kmeans, unsupervisied learning is executed to form clusters of colors inside a given panel. The system is aiming to determine the $2^{nd}$ tier of most dominate colors (i.e., avoid the blue that the device is mainly comprised of). A given identified color may correspond to one or two types of results, depending on the type of diagnostic test with which the color is associated. For example, for metabolic tests the colors are quantitative—a certain collection of RGB values represents a single quantitative number. Alternatively, for a binary diagnostic test (e.g., a positive or negative result) the presence or absence of a color (or colors) can indicate a positive or negative result.

The system determines the color in each rectangle by clustering the pixels and making a histogram, and then normalizing the histogram. The system then determines RGB, modulates the result to HEX and then modulates the RGB to a name. The resulting image is stored at the computer processing device 503.

Any results of the image processing may be displayed in a graphical user-interface generated at the comm. device 503 and/or the computing device 508. Such graphical-user interfaces may include various buttons, fields, forms, components, data streams, and/or the like, any of which may be used to visualize the results.

Figure 7:
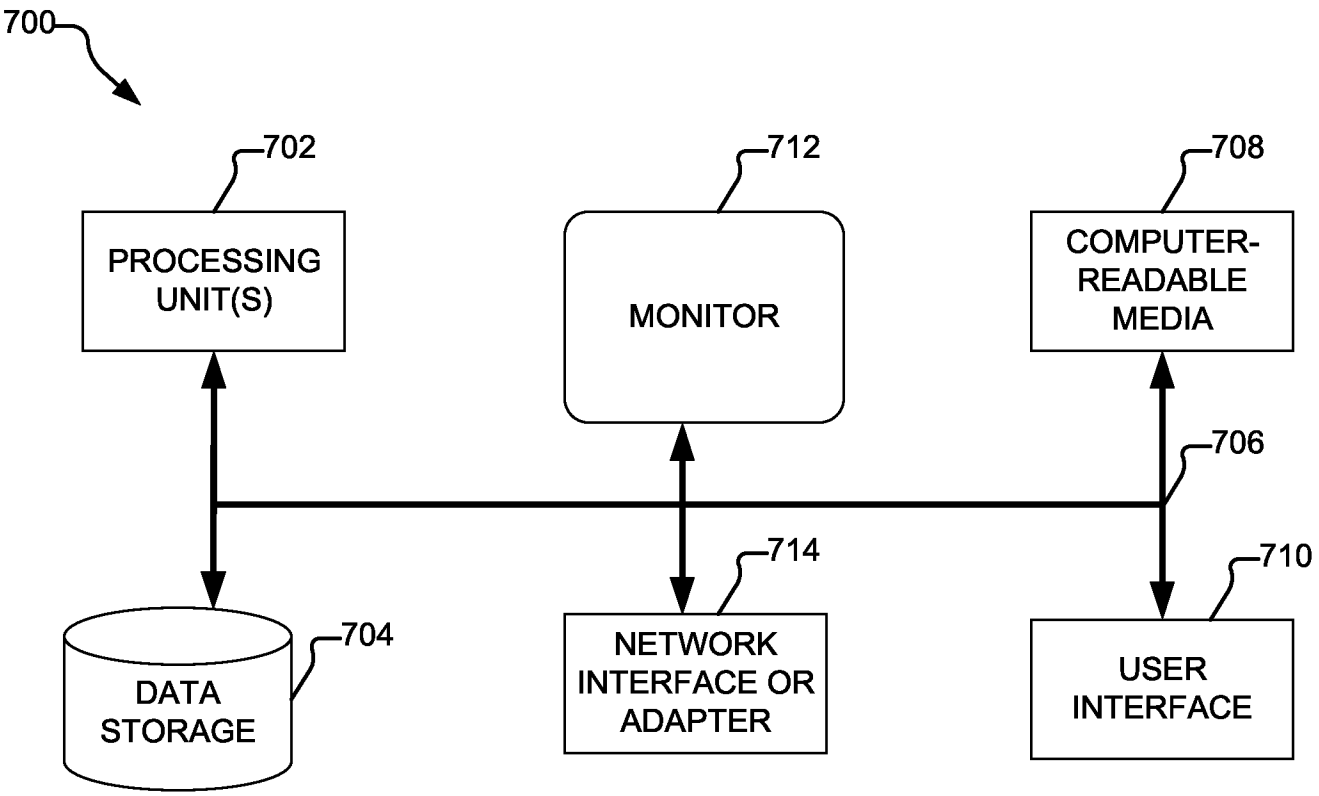
FIG. 7 shows an example computing and networking environment.

FIG. 7 illustrates an example of a suitable computing and networking environment 700 that may be used to implement various aspects of the present disclosure described in FIGS. 1-6, such as the computing device 508. As illustrated, the computing and networking environment 700 includes a general purpose computing device 700, although it is contemplated that the networking environment 700 may include one or more other computing systems, such as personal computers, server computers, hand-held or laptop devices, tablet devices, multiprocessor systems, microprocessor-based systems, set top boxes, programmable consumer electronic devices, network PCs, minicomputers, mainframe computers, digital signal processors, state machines, logic circuitries, distributed computing environments that include any of the above computing systems or devices, and the like.

Components of the computer 700 may include various hardware components, such as a processing unit 702, a data storage 704 (e.g., a system memory), and a system bus 706 that couples various system components of the computer 700 to the processing unit 702. The system bus 706 may be any of several types of bus structures including a memory bus or memory controller, a peripheral bus, and a local bus using any of a variety of bus architectures. For example, such architectures may include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer 700 may further include a variety of computer-readable media 708 that includes removable/non-removable media and volatile/nonvolatile media, but excludes transitory propagated signals. Computer-readable media 708 may also include computer storage media and communication media. Computer storage media includes removable/non-removable media and volatile/nonvolatile media implemented in any method or technology for storage of information, such as computer-readable instructions, data structures, program modules or other data, such as RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that may be used to store the desired information/data and which may be accessed by the computer 700. Communication media includes computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. For example, communication media may include wired media such as a wired network or direct-wired connection and wireless media such as acoustic, RF, infrared, and/or other wireless media, or some combination thereof. Computer-readable media may be embodied as a computer program product, such as software stored on computer storage media.

The data storage or system memory 704 includes computer storage media in the form of volatile/nonvolatile memory such as read only memory (ROM) and random access memory (RAM). A basic input/output system (BIOS), containing the basic routines that help to transfer information between elements within the computer 700 (e.g., during start-up) is typically stored in ROM. RAM typically contains data and/or program modules that are immediately accessible to and/or presently being operated on by processing unit 702. For example, in one embodiment, data storage 704 holds an operating system, application programs, and other program modules and program data.

Data storage 704 may also include other removable/non-removable, volatile/nonvolatile computer storage media. For example, data storage 704 may be: a hard disk drive that reads from or writes to non-removable, nonvolatile magnetic media; a magnetic disk drive that reads from or writes to a removable, nonvolatile magnetic disk; and/or an optical disk drive that reads from or writes to a removable, nonvolatile optical disk such as a CD-ROM or other optical media. Other removable/non-removable, volatile/nonvolatile computer storage media may include magnetic tape cassettes, flash memory cards, digital versatile disks, digital video tape, solid state RAM, solid state ROM, and the like. The drives and their associated computer storage media, described above and illustrated in FIG. 7, provide storage of computer-readable instructions, data structures, program modules and other data for the computer 700.

A user may enter commands and information through a user interface 710 or other input devices such as a tablet, electronic digitizer, a microphone, keyboard, and/or pointing device, commonly referred to as mouse, trackball, or touch pad. Other input devices may include a joystick, game pad, satellite dish, scanner, or the like. Additionally, voice inputs, gesture inputs (e.g., via hands or fingers), or other natural user interfaces may also be used with the appropriate input devices, such as a microphone, camera, tablet, touch pad, glove, or other sensor. These and other input devices are often connected to the processing unit 702 through a user interface 710 that is coupled to the system bus 706, but may be connected by other interface and bus structures, such as a parallel port, game port or a universal serial bus (USB). A monitor 712 or other type of display device is also connected to the system bus 706 via an interface, such as a video interface. The monitor 712 may also be integrated with a touch-screen panel or the like.

The computer 700 may operate in a networked or cloud-computing environment using logical connections of a network interface or adapter 714 to one or more remote devices, such as a remote computer. The remote computer may be a personal computer, a server, a router, a network PC, a peer device or other common network node, and typically includes many or all of the elements described above relative to the computer 700. The logical connections depicted in FIG. 7 include one or more local area networks (LAN) and one or more wide area networks (WAN), but may also include other networks. Such networking environments are commonplace in offices, enterprise-wide computer networks, intranets and the Internet.

When used in a networked or cloud-computing environment, the computer 700 may be connected to a public and/or private network through the network interface or adapter 714. In such embodiments, a modem or other means for establishing communications over the network is connected to the system bus 706 via the network interface or adapter 714 or other appropriate mechanism. A wireless networking component including an interface and antenna may be coupled through a suitable device such as an access point or peer computer to a network. In a networked environment, program modules depicted relative to the computer 700, or portions thereof, may be stored in the remote memory storage device.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the disclosure and are thus within the spirit and scope of the present disclosure. From the above description and drawings, it will be understood by those of ordinary skill in the art that the particular embodiments shown and described are for purposes of illustrations only and are not intended to limit the scope of the present disclosure. References to details of particular embodiments are not intended to limit the scope of the disclosure.

EXAMPLES

The present invention is next described by means of the following examples. The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Example 1—Manufacturing Method

This example describes a method for manufacturing a single-layer microfluidic device of the present disclosure.

Apparatus and Equipment

Printer (e.g., Xerox ColorQube 8570N Solid Ink Color Printer-2400 dpi)

Filter paper

Hot plate

Procedure

The following procedure is performed with a multi-cartridge printer.

(a) Print the base pattern (wax boundaries of main channel, fluid transfer channels, and diagnostic areas): Ensure a printer cartridge containing melted wax is installed in the printer. Insert a single sheet of filter paper into the printer and print the base pattern including a main channel, three fluid transfer channels, and three corresponding diagnostic areas (as shown in FIG. 1) for multiple devices on one sheet of paper.

(b) Melt the printed wax: Using a hotplate at 150° C., heat the printed filter paper for approximately 15 seconds to melt the wax. During heating, the wax will visibly seep into the filter paper. The wax will also darken in color while it is heating, and will return to its original color after being removed from heat. Cool to room temperature.

(c) Print the backing: Ensure a printer cartridge containing melted wax is installed in the printer. Return the filter paper from step (d) to the printer upside down so as to print onto the back side of the paper, and print a continuous layer of wax on the back of the paper, so as to cover the back of each device.

(d) Print the identifying indicia: Ensure a printer cartridge containing ink is installed in the printer. Return the filter paper from step (c) to the printer, and print a QR code (or other identifying indicia) in an area outside the wax boundaries of the main channel, fluid transfer channels, and diagnostic areas. For example, a QR code may be printed in a top left corner of each device. This step may be repeated to print different identifying indicia (e.g., colored dots or different QR codes corresponding to different devices), as needed.

(e) Print the top-layer template (diagnostic components): Ensure a printer cartridge containing a solution of the desired diagnostic component(s) is installed in the printer. Return the filter paper from step (b) to the printer, and print the diagnostic component(s) within the wax boundary of each printed diagnostic area, as desired. For instance, one or more diagnostic areas may be printed with a single combination of reagent and dye, and one or more diagnostic areas may be printed with a different combination of reagent, dye, and stabilizer. Accordingly, this step may be repeated with additional diagnostic component(s), as needed to achieve the desired devices, waiting approximately 10 minutes before each additional printing.

(f) Separate the devices: Cut the devices from the fully printed filter paper. The individual devices are now ready for use with a biological sample.

(g) Attach filter (optional): If a filter is required (e.g., to remove red blood cells from a biological blood sample), use an adhesive to attach a small piece of filter paper to the top-layer at an inlet to the main channel.

Example 2—Manufacturing Method

This example describes a method for manufacturing a single-layer microfluidic device of the present disclosure.

Apparatus and Equipment

Printer (e.g., Xerox ColorQube 8570N Solid Ink Color Printer)

Filter paper

Hot plate

Adhesive tape (e.g., 3M transpose clear tape)

Procedure

The following procedure is performed with a multi-cartridge printer.

(a) Print the base pattern (wax boundaries of main channel, fluid transfer channels, and diagnostic areas): Ensure a printer cartridge containing melted wax is installed in the printer. Print template onto plain paper: Insert a sheet of plain paper into the printer and print a base pattern including a main channel, three fluid transfer channels, and three corresponding diagnostic areas (as shown in FIG. 1) for multiple devices on one sheet of paper. Attach filter paper: Tape multiple non-layered pieces of filter paper to the wax-printed side of the plain paper. Print template onto filter paper: Place the attached papers in the printer in the same manner as initially done so as to reprint the same base-layer template onto the filter paper side of the attached papers. Separate the filter papers: Detach the filter papers from the plain paper, and discard the plain paper.

(a) Melt the printed wax: Using a hotplate at 150° C., heat the wax-printed filter paper for approximately 15 seconds to melt the wax. During heating, the wax will visibly seep into the filter paper. The wax will also darken in color while it is heating, and will return to its original color after being removed from heat. Cool to room temperature.

(b) Print the backing: Ensure a printer cartridge containing melted wax is installed in the printer. Tape the filter papers from step (b) to a sheet of plain paper, and then insert into printer upside down so as to print onto the back sides of the filter papers, and print a continuous layer of wax on the back of the each filter paper, so as to cover the back of each device. Detach the filter papers from the plain paper, and discard the plain paper.

(c) Print the identifying indicia: Ensure a printer cartridge containing ink is installed in the printer. For each filter paper device from step (b), return the device to the printer, and print the desired QR code (or other identifying indicia) in an area outside the wax boundaries of the main channel, fluid transfer channels, and diagnostic areas. This step may be repeated to print additional identifying indicia (e.g., colored dots), as needed.

(d) Print the top-layer template (diagnostic components): Ensure a printer cartridge containing a solution of the desired diagnostic component(s) is installed in the printer. For each filter paper device from step (b), return the device to the printer, and print the desired diagnostic component(s) onto the filter paper. The diagnostic component(s) are printed within the wax boundary of each printed diagnostic area, as desired. For instance, one or more diagnostic areas may be printed with a single combination of reagent and dye, and one or more diagnostic areas may be printed with a different combination of reagent, dye, and stabilizer. Accordingly, this step may be repeated with additional diagnostic component(s), as needed to achieve the desired devices, waiting approximately 10 minutes before each additional printing.

Alternatively, instead of using a printer to deposit the diagnostic component(s) on the devices, diagnostic component(s) may be manually deposited onto the diagnostic areas using a pipette or other similar instrument in amounts of about 1 μL.

(e) Ready for use: After all of the desired diagnostic component(s) have been printed, the devices are ready for use with biological samples.

Example 3—Calcium Colorimetric Assay

This example describes diagnostic components that include a visual indicator and selectively associate with calcium as the target analyte.

Dye Solution: methylmol blue, sodium salt, polyvinylpyrrolidone (PVP), 8-quinolinol, and hydrochloric acid.

Base Solution: sodium sulfite and monoethanolamine.

A combination of the above-identified Dye Solution and Base Solution make up the diagnostic components that are then deposited in one or more diagnostic areas of a single layer microfluidic device of the present disclosure. The device may then be used as disclosed herein to detect and quantify the presence of calcium in a biological sample deposited onto the main channel of the device.

All references cited and/or discussed in this specification are incorporated herein by reference in their entireties and to the same extent as if each reference was individually incorporated by reference.

What is claimed is:

1. A method of manufacturing a single layer microfluidic, comprising:

(a) obtaining a single layer sheet of hydrophilic, porous paper having a front and a back;

(b) printing at least two patterns of wax boundaries onto the front of the paper, wherein each pattern corresponds to a single device comprising a main channel, at least two fluid transfer channels, and an independent diagnostic area corresponding to each fluid transfer channel, wherein the main channel is in fluid communication with each of the fluid transfer channels, and wherein the fluid transfer channels are independent of each other and in fluid communication with their corresponding diagnostic areas;

(c) heating the paper of step (b) at a temperature of about 120° C. to about 150° C. to melt the wax deposited in step (b) through the thickness of the paper, and then cooling the paper to room temperature;

(d) after step (c), printing a wax barrier onto the back of the paper such that the wax barrier has a thickness of 50—100 μm and covers all of the back of the paper;

(e) directly after the wax barrier is printed in step (d), printing a first reagent onto each diagnostic area of the paper, and then, after at least 10 minutes, printing a dye onto each diagnostic area of the paper, and then, after at least 10 minutes, printing a stabilizer onto at least one diagnostic area of the paper;

(f) cutting out individual devices from the paper; and (g) for each device, attaching a paper filter to an inlet of the main channel at a position upstream of the main channel.

2. The method of claim 1, further comprising depositing at least one identifying indicator onto the paper outside of the main channel, fluid transfer channels, and diagnostic areas before step (f).

3. The method of claim 2, wherein at least one identifying indicator is a QR code or bar code.

4. The method of claim 2, wherein at least one identifying indicator is a calibration region.

5. The method of claim 1, wherein the hydrophilic, porous paper is filter paper.

6. The method of claim 1, wherein step (f) comprises cutting out an array of two devices.

7. The method of claim 1, wherein the paper filter is attached to the inlet of the main channel using an adhesive.

* * * * *